US006690103B1

(12) United States Patent
Uke

(10) Patent No.: US 6,690,103 B1
(45) Date of Patent: Feb. 10, 2004

(54) INCANDESCENT LIGHT BULB WITH VARIABLE PITCH COILED FILAMENT

(76) Inventor: Alan K. Uke, 355 14th St., Del Mar, CA (US) 92014

( * ) Notice: Subject to any disclaimer, the term of this patent is extended or adjusted under 35 U.S.C. 154(b) by 0 days.

(21) Appl. No.: 09/565,602

(22) Filed: May 4, 2000

Related U.S. Application Data

(63) Continuation-in-part of application No. 09/358,092, filed on Jul. 21, 1999.

(51) Int. Cl.[7] ..... H01J 1/10
(52) U.S. Cl. ..... 313/344; 313/491; 313/631
(58) Field of Search ..... 313/491, 631, 313/341, 344

(56) References Cited

U.S. PATENT DOCUMENTS

| | | | | |
|---|---|---|---|---|
| 1,105,908 | A | | 8/1914 | Hughes |
| 1,632,769 | A | | 6/1927 | Severin |
| 2,454,765 | A | | 11/1948 | Braunsdorff |
| 3,195,005 | A | | 7/1965 | Freeman |
| 3,431,448 | A | | 3/1969 | English |
| 3,464,836 | A | | 9/1969 | Pendleton et al. |
| 3,538,374 | A | | 11/1970 | Kane |
| 3,558,374 | A | | 1/1971 | Boss et al. |
| 3,665,240 | A | | 5/1972 | Archer |
| 3,705,325 | A | | 12/1972 | Anstad |
| 3,930,178 | A | | 12/1975 | Coaton |
| 3,942,063 | A | | 3/1976 | Winter et al. |
| 4,209,229 | A | | 6/1980 | Rittler |
| 4,355,259 | A | | 10/1982 | Weiss |
| 4,598,342 | A | * | 7/1986 | English et al. ..... 313/273 |
| 4,916,935 | A | | 4/1990 | Novack et al. |
| 5,571,561 | A | | 11/1996 | LePetitcorps et al. |
| 5,686,786 | A | | 11/1997 | Lang et al. |

FOREIGN PATENT DOCUMENTS

| | | | |
|---|---|---|---|
| EP | 0123844 | A | 10/1989 |
| JP | 08069779 | A | 3/1996 |
| JP | 09265958 | A | 10/1997 |
| WO | 01/91161 | | 11/2001 |

* cited by examiner

*Primary Examiner*—Vip Patel

(57) ABSTRACT

An incandescent light bulb includes a lamp envelope, a coiled filament with a predetermined amperage rating disposed inside the lamp envelope, and current supply wires that electrically connect a pair of opposite terminal ends of the filament to a power supply. The power supply has a predetermined nominal voltage range for causing a current to flow through the filament sufficient to heat the same to a temperature at which it emits visible light. In one arrangement the filament has a pair of end segments and a central segment between the end segments. The end segments of the filament have a first pitch which is smaller than a second pitch of the central segment of the filament. With this configuration, more of the length of the coil will be heated to the maximum operating temperature while avoiding peak temperature areas that lead to failures. The variable pitch of the filament increases the brightness of the light bulb without decreasing its life.

17 Claims, 4 Drawing Sheets

INCANDESCENT LIGHT BULB WITH VARIABLE PITCH COILED FILAMENT

CROSS-REFERENCE TO RELATED APPLICATION

This application is a continuation-in-part of U.S. patent application Ser. No. 09/358,092, filed Jul. 21, 1999, having the same title and inventor.

BACKGROUND OF THE INVENTION

The present invention relates to incandescent light bulbs, and more particularly, to constructions for such light bulbs designed to increase the amount of visible light that they emit or to increase the bulbs' life-span.

A conventional incandescent light bulb, hereinafter sometimes referred to simply as a light bulb, comprises a coiled (usually helically wound) tungsten wire filament which is supported inside a glass globe or other suitable envelope. The ends of the wire filament are connected to, and supported by, the outer ends of corresponding current supply wires. The inner ends of the current supply wires are usually connected to terminals in a base of the light bulb to facilitate connection to a source of electrical power supplied to a socket or other connector in which the bulb is mounted. When current flows through the wire filament, it heats to a very high temperature and gives off visible light. A vacuum may be drawn on the glass envelope or it may be filled with an inert gas such as krypton, halogen or xenon which can contribute to the life-span and efficiency of the light bulb.

The power used by a light bulb is indicated by its rating in watts. This is a measure of how much power is consumed by the wire filament of the light bulb. The wattage rating of a light bulb is determined by several factors, including the thickness, length and configuration of its wire filament. The amperage at which electricity passes through the filament is directly proportional to an applied voltage. The power rating of a light bulb is usually expressed in terms of watts, with the wattage of a light bulb being the product of the bulb' current rating in amps times the voltage being applied. By way of example, a light bulb might be specified with a rating of 6.00V/0.50 A, in which case the light bulb'power would be three Watts. At a given voltage, the higher the amperage, the greater the power, and theoretically, the greater the brightness of the light bulb.

In addition to the power supplied to a light bulb, its perceived brightness is affected by many other factors, including the construction of the light bulb (e.g. gas fill and pressure of fill), and the construction and shape of the filament. Perceived brightness is also a function of the color temperature of the light emitted by the filament.

There are scientific measurements of brightness called footcandles (or candela) and lumens. The brightness of a light bulb can be empirically determined in a laboratory in candela or lumens by carefully controlling the applied voltage, the mechanical factors and the environment around the light bulb. Such conditions are generally not reproducible in the field. Therefore, most light bulb manufacturers do not provide candela or lumen ratings for their light bulbs. The wattage rating for a light bulb therefore commonly provides a rough guide to its brightness.

Most incandescent light bulbs are designed to operate at a specific nominal or design voltage. If the voltage supplied is too high, the wire filament can melt and/or break. If the voltage is too low, the brightness of the light bulb will be diminished. A slight over-voltage, e.g. ten to fifteen percent, can make a light bulb glow much brighter, but at the expense of its life expectancy. A slight under-voltage will cause the light bulb to burn less brightly, but its life expectancy will be increased. A problem with light bulbs intended for use with battery power is that the voltage supplied is not stable. As an example, four standard Alkaline C cells may supply a combined six volts at the beginning of their life, but then the supplied voltage can eventually dip to under five volts as the batteries drain.

There are many applications where it would be desirable to provide an incandescent light bulb intended to be powered via batteries which will produce the maximum amount of brightness for a given power consumption. Such a light bulb must still provide a reasonable life expectancy, such as twenty to fifty hours of operating time. Foremost among these applications is the flashlight, whether used in the household, by law enforcement personnel and fireman, or in more exotic applications such as underwater diving.

SUMMARY OF THE INVENTION

It is therefore an object of the present invention to provide an improved incandescent light bulb that will provide increased illumination. It is another separate object of the present invention to provide an improved light bulb that provides a longer life expectancy for a given power consumption.

In accordance with the present invention, an incandescent light bulb includes a lamp envelope, a coiled filament disposed inside the lamp envelope, and current supply wires that electrically connect a pair of opposite terminal ends of the filament to a power supply. The power supply has a predetermined nominal voltage range for causing a current to flow through the filament sufficient to heat the same to a temperature at which it emits visible light. In one arrangement the filament has a pair of end segments and a central segment between the end segments. The end segments of the filament have a first pitch which is smaller than a second pitch of the central segment of the filament. With this configuration, more of the wire length of the filament will be heated to the highest operating temperature. Because the filament typically fails at the hottest point, the critical peak temperature of the filament which causes low voltage lamps to fail is eliminated and light bulb life expectancy is increased. The variable pitch filament increases the brightness of the light bulb without decreasing its life, or increases life without decreasing brightness.

DESCRIPTION OF THE PREFERRED EMBODIMENTS

Figure 1:
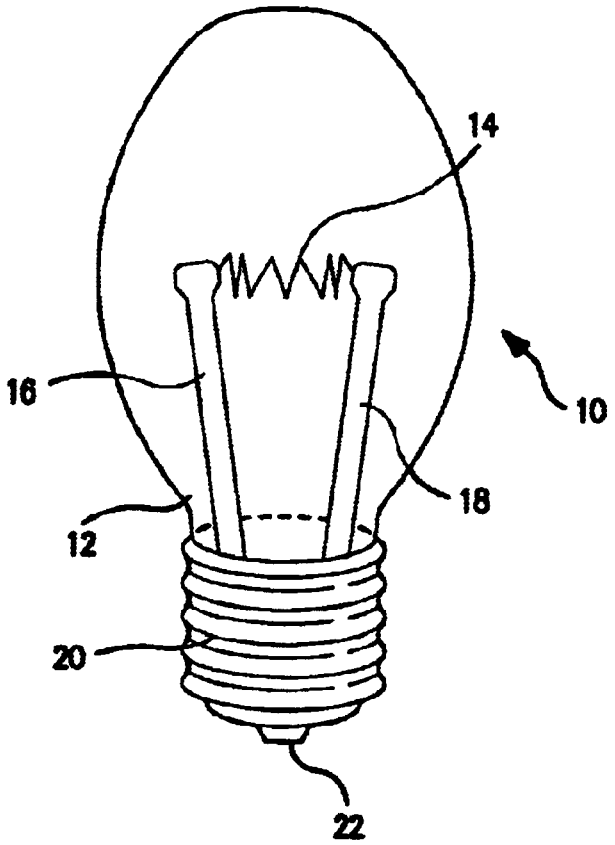
FIG. 1 is a perspective view of an incandescent light bulb in accordance with a preferred embodiment of the present invention.

Referring to FIG. 1, an incandescent light bulb 10 constructed in accordance with a preferred embodiment of the present invention is shown. The light bulb 10 comprises a glass lamp envelope 12 and a helical coiled filament 14 disposed inside the lamp envelope 12. The filament 14 is made of a suitable material, such as tungsten, although it will be appreciated that any suitable material that can generate radiation of a desired frequency can also be used. The diameter and length of the wire comprising the filament 14 provide it with a predetermined amperage rating. The metal wire comprising the filament 14 may be coated with ceramic, carbon or other suitable non-metallic material to increase brightness. Preferably the coating has a lower conductivity than that of the filament 14.

Figure 2:
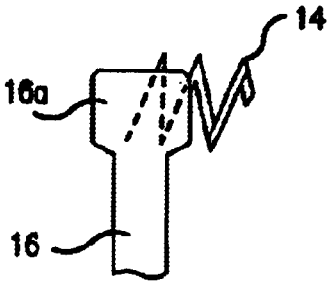
FIG. 2 is an enlarged fragmentary view illustrating the manner in which the terminal ends of the filament of the light bulb of FIG. 1 are clamped in the ends of its current supply wires.

Means are provided for electrically connecting a pair of opposite terminal ends of the filament 14 to a power supply (not shown). The illustrated connecting means includes a pair of current supply wires 16 and 18 (FIG. 1). The terminal ends of the filament 14 are clamped in the bent outer ends such as 16*a* (FIG. 2) of the current supply wires 16 and 18, which are in turn coupled to a supply voltage. Referring again to FIG. 1, the inner ends of the current supply wires 16 and 18 are electrically connected to a threaded conductive male threaded base 20 and central conductor 22, respectively. The base 20 and conductor 22 are separated by a suitable dielectric member (not shown) which also supports the supply wires 16 and 18 in spaced apart relationship. The inner end of the lamp envelope 12 is secured to the threaded base 20 in an airtight fashion. A vacuum may be drawn on the lamp envelope 12 or it may be filled with an inert gas such as krypton, halogen or xenon, depending the design of the light bulb 10. It will be appreciated that other bulb design and components may be used. The threaded base 20 may be screwed into a female threaded socket (not shown) connected to batteries or some other source of electric power having a predetermined nominal voltage range for causing a current to flow through the filament 14. The current flow is sufficient to heat the filament 14 to a high enough temperature so that it emits light in the visible portion of the electromagnetic spectrum. Although the disclosed example is directed to visible light, it will be appreciated another frequency, such as infrared, may be generated.

Figure 3:
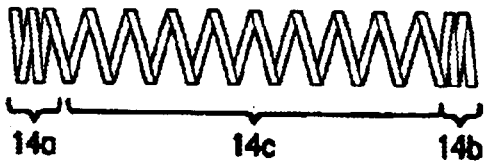
FIG. 3 is an enlarged side elevation view of the filament of the light bulb of FIG. 1 illustrating the different pitches of the end and central segments of its helical coiled filament.

As shown in FIG. 3, the filament 14 has a pair of end segments 14*a* and 14*b* and a central segment 14*c* between the end segments. The end segments 14*a* and 14*b* of the filament 14 have a first pitch which is smaller than a second pitch of the central segment 14*c* of the filament. As used herein, the term "pitch" in regard to the filament 14 refers to the distance between adjacent turns of the filament, each turn being defined by a single three hundred and sixty degree revolution of the wire comprising the filament 14. The turns of the coil filament 14 could have round, oval, square or any other suitable configuration. The first and second pitches and the number of turns in each segment are selected so that the peak operating temperature of the filament 14 will be lower than the peak operating temperature of the same filament having only the second larger pitch throughout its entire length. This occurs because the turns of the end segments 14*a* and 14*b* are heated to the highest operating temperature due to their close proximity. Thus, the coils in the center are heated to substantially the same operating temperature. This eliminates areas of the wire filament that have a sharp temperature peak or a disproportionately higher temperature that leads to failures. A longer length of the wire filament 14 will be at the maximum operating temperature without any turns having a peak temperature that is substantially higher than the temperature of the other turns. This design increases the life expectancy of the light bulb 10 and also results in an increase in brightness without an increase in a power consumption or a decrease in bulb life.

The ratios of the number of turns in the segments 14*a* and 14*b* versus 14*c* will depend upon the amount of power the filament 14 is designed to dissipate. By way of example, where the filament 14 is designed to work with a three volt lithium battery, filament 14 may be wound from 0.001 inch Tungsten wire, and the segments 14*a* and 14*b* may be three turns each whereas the central segment may be four turns. It will be appreciated that other relationships and ratios may be used. In the described example, the first pitch of the end segments 14*a* and 14*b* may be optionally selected so that its turns are close to touching. In another example, the second pitch of the central segment 14*c* may be half the diameter of its turns. Preferably the first pitch is at least five percent less than the second pitch, and more preferably, the first pitch is between about twenty to about fifty percent less than the second pitch, although ratios may be selected, for example, in the range of about one percent to about ninety percent less than the second pitch.

By way of comparison, in a bulb having a known conventional tungston filament only a limited number of turns provide the majority of the visible light. For example, in a known bulb designed to operate with a three volt lithium battery having a tungston filament with ten turns at a constant pitch, typically only three turns of the filament provide a majority of the visible light. However, using a variable pitch coil in accordance with the present invention, it is possible to have a higher number of turns providing the majority of the visible light. For example, in a bulb designed to operate with a three volt lithium battery having a filament with ten turns at a variable pitch, at least four turns provide a majority of the visible light. It is therefore an advantage that a bulb with a variable pitch coil in accordance with the present invention can emit more perceived light than a known conventional filament bulb operating under similar conditions.

In another example, a light bulb in accordance with the present invention has a variable pitch filament and operates with a 1.5 volt battery. Using this bulb with the variable pitch filament, two turns of the filament generate the majority of the visible light. In contrast, a bulb with a known tungston filament operating with a 1.5 volt battery typically will generate the majority of visible light with only one turn of the conventional filament. Accordingly, the bulb made in accordance with the present invention will emit more visible light as compared to a conventional bulb. Alternatively, the filament made in accordance with the present invention may be operated at a lower peak temperature and still emit nearly the same perceived visible light as the conventional filament operating at a higher peak temperature. In such a manner the life expectancy for the bulb made in accordance with the present invention is increased as compared to the conventional bulb.

Although the described examples use a pair of end segments and a center segment, it will be appreciated that any number of segments may be used. For example, a variable pitch filament may be arranged with five segments, with adjacent segments having a different pitch, thereby forming a variable pitch filament. Further, it will be appreciated that the pitch can remain constant in a segment, or can be varied through a segment or across the length of the filament.

Figure 4:
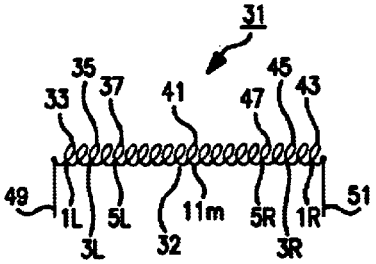
FIG. 4 PRIOR ART
FIG. 4 is an illustration of a known conventional coiled filament.
Figure 7:
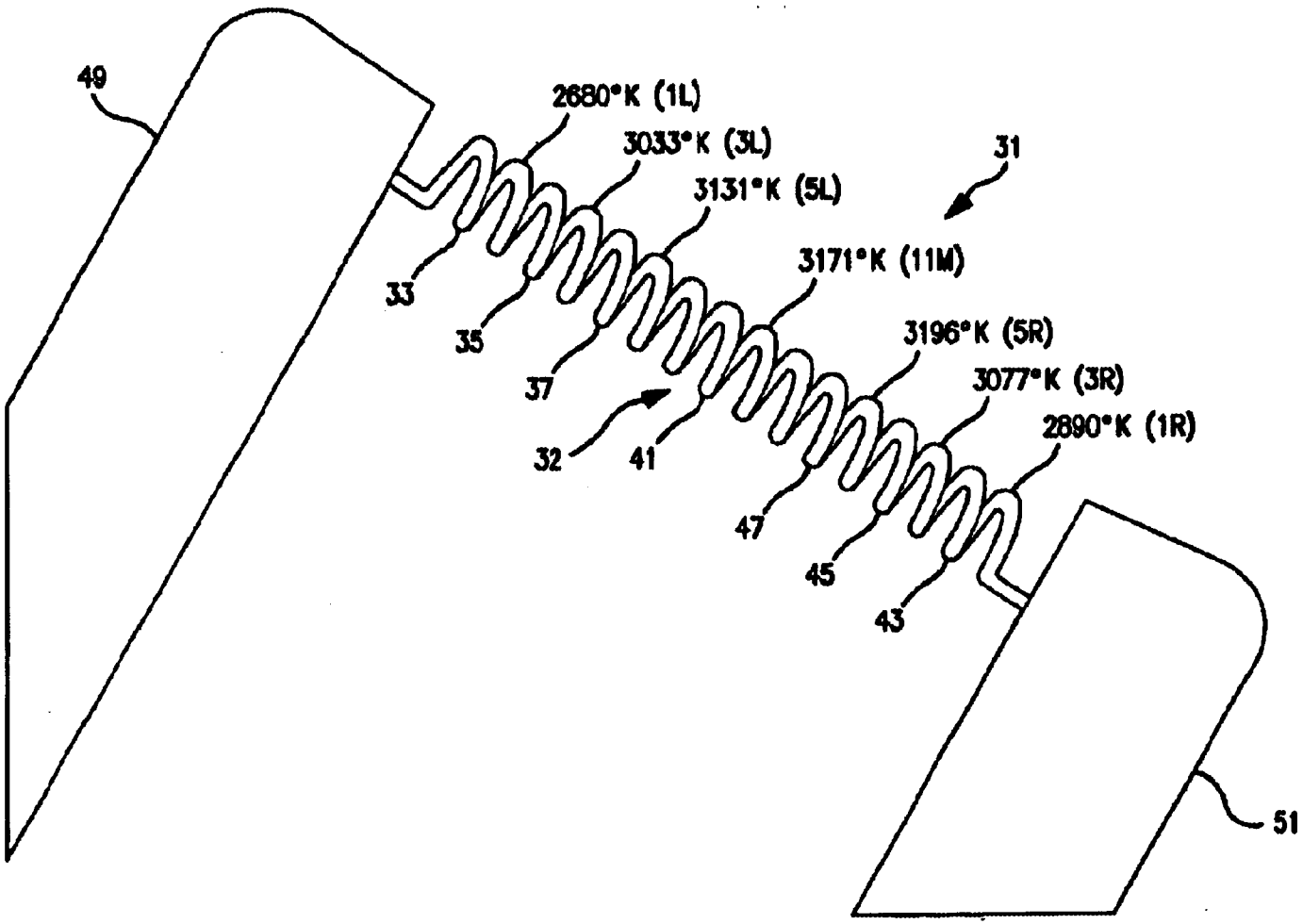
FIG. 7 is a pictorial representation of a known coiled filament.

In a further example, a variable pitch coiled filament was compared to a known conventional tungston filament. FIGS. 4 and 7 illustrate the known conventional tungston filament 31. Supply wires 49 and 51 are connected to filament wire 32. The filament wire had twenty-one coils, with the coils arranged in a helical arrangement and with a constant pitch. As the filament wire 31 has twenty-one coils, the eleventh (11M) coil 41 is positioned at substantially the center of the filament wire 32. The first (1L) coil 33 on the left, the third (3L) coil 35 on the left and the fifth (5L) coil 37 on the left are identified in FIG. 4. In a similar manner, the first (1R) coil 43 on the right, the third (3R) coil 45 on the right, and the fifth (5R) coil 47 on the right are also identified in FIG. 4.

Figure 5:
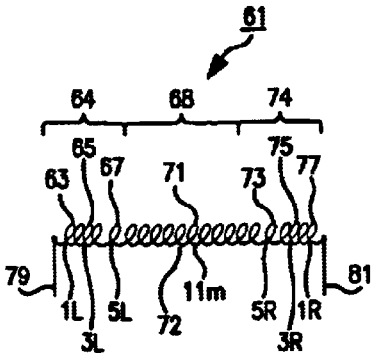
FIG. 5 is an illustration of a coiled filament made in accordance with the present invention.
Figure 8:
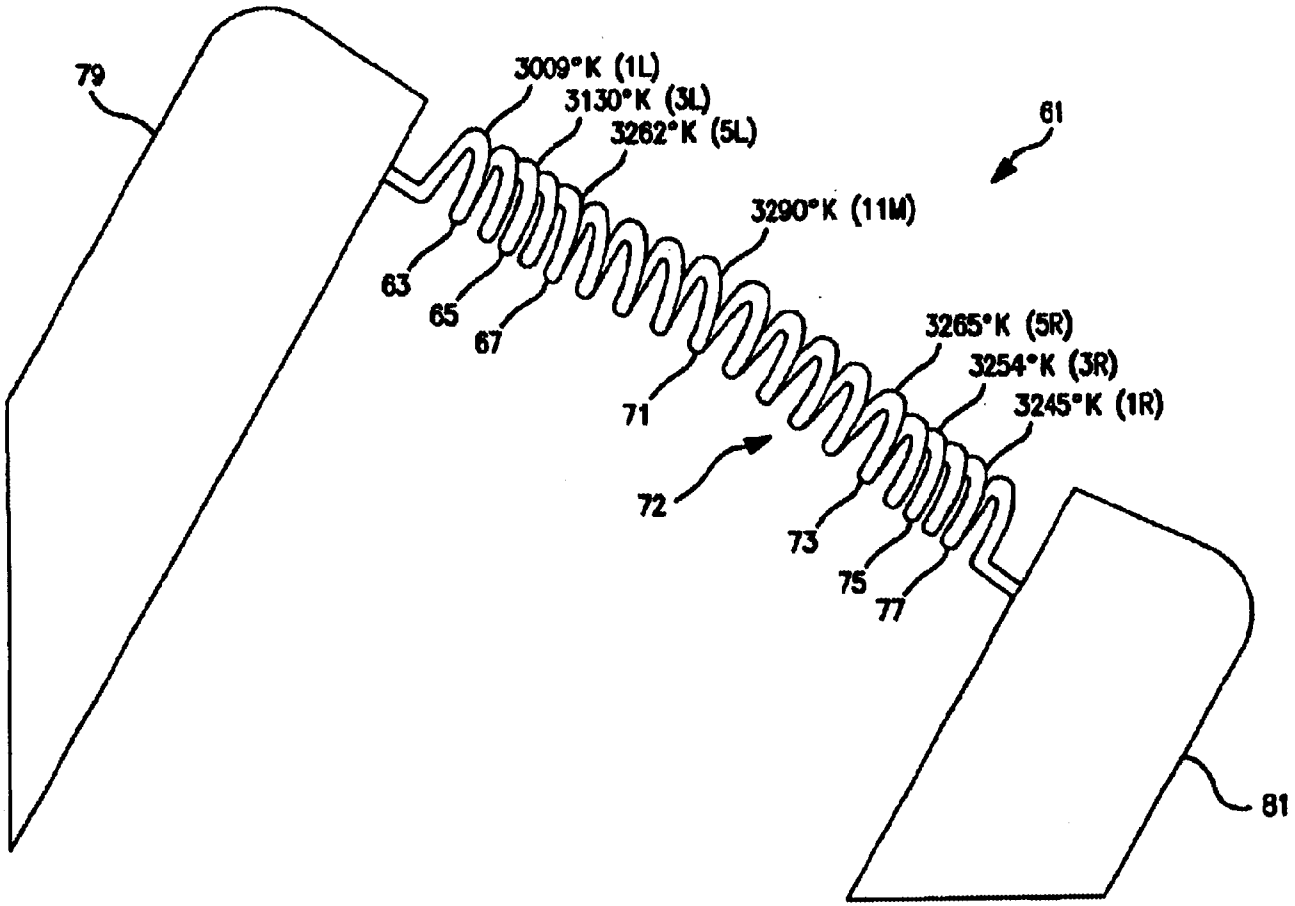
FIG. 8 is a pictorial representation of a variable pitch coiled filament in accordance with the present invention.

FIGS. 5 and 8 illustrate the variable pitch filament 61 in accordance with the present invention which was tested. Supply wires 79 and 81 are connected to the filament wire 72. The filament wire 72 has twenty-one coils arranged in a left-end segment 64, a right-end segment 74, and a center segment 68. The eleventh (11M) coil 71 is substantially at the center of the coiled filament wire 72. The first (1L) coil 63 on the left, the third (3L) coil 65 on the left, and the fifth (5L) coil 67 on the left are identified. In a similar manner, the first (1R) coil 77 on the right, the third (3R) coil 75 in the right, and the fifth (5R) coil 73 on the right are also identified.

Both the filament 32 in the known device and the variable pitch coil filament wire 72 of the inventive device were connected to the same voltage, and the temperature of each identified coil was measured. Due to other variables in the test, the peak voltage of the variable pitch coil filament was recorded higher than the peak temperature of the conventional filament. It will be appreciated that the construction of the variable pitch filament can be adjusted to have a peak temperature at or below the peak temperature for conventional known filament. The results are shown in Table 1. These results are also shown in a graphical form in FIG. 6, where the vertical axis 93 corresponds to color and the horizontal axis 95 corresponds to coil position.

TABLE 1

| Coil Position | Conventional Filament (FIG. 4) Temperature | Coil Position | Variable Pitch Filament (FIG. 5) Temperature |
|---|---|---|---|
| 33 | 2680 | 63 | 3009 |
| 35 | 3033 | 65 | 3130 |
| 37 | 3131 | 67 | 3262 |
| 41 | 3171 | 71 | 3290 |
| 43 | 3196 | 73 | 3265 |
| 45 | 3077 | 75 | 3254 |
| 47 | 2890 | 77 | 3245 |

Figure 6:
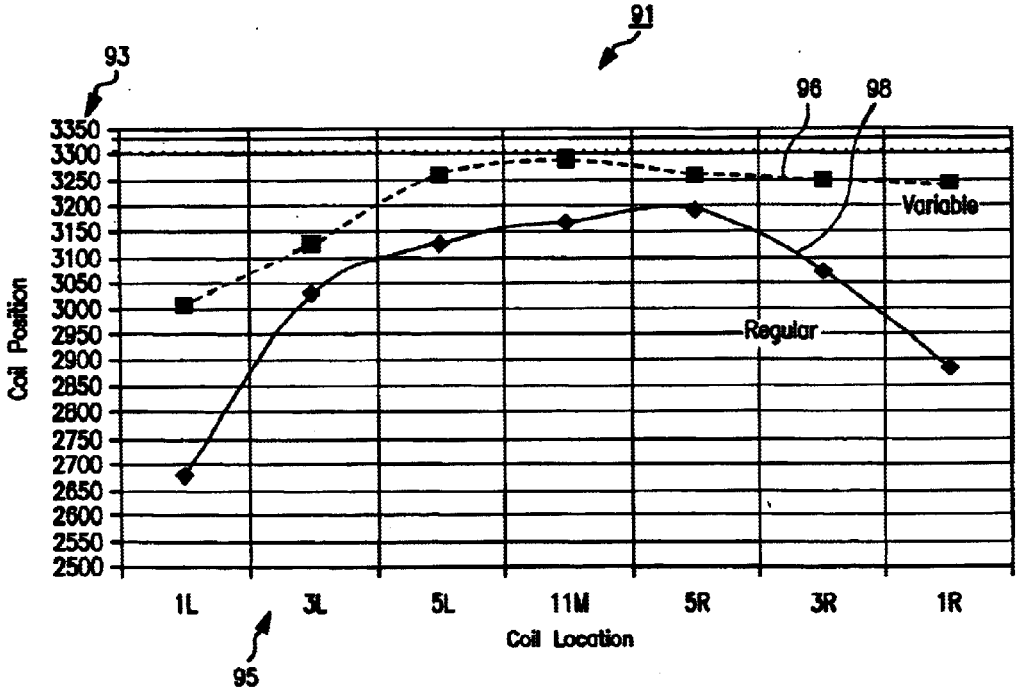
FIG. 6 is a temperature chart comparing a known coiled filament to a variable pitch coiled filament in accordance with the present invention.

Referring to FIG. 6, line 98 illustrates the temperature for the conventional coil filament and dotted line 96 illustrates the coil temperature for the variable pitch coil filament. It is seen that line 98 (the conventional coil) has a sharp peak at the SR coil 43. In contrast, dotted line 96 is relatively flat from the 5L coil 67 to the 1R coil 77. It will be understood that the majority of the visible light is emitted from the coil or coils near the peak temperature. Since the variable pitch filament has a flatter curve, and therefore more coils near the peak temperature, for any given peak temperature the variable pitch filament will emit more visible light than a conventional known filament at the same peak temperature. Accordingly, to achieve about the same level of perceived light, the variable pitch coil filament can be operated at a lower peak temperature as compared to a known conventional filament, thereby increasing the life expectancy of the bulb made in accordance with the present invention. Alternatively, if operated at substantially the same peak temperature, the variable pitch coil filament will emit more visible light as compared to a known conventional filament bulb.

By using the variable pitch coiled filament, it has been found that the life expectancy of a bulb can be increased by 50% as compared to a known bulb with the same wattage rating. Further, because the variable pitch coil has a flatter temperature curve, it has a higher average temperature and is therefore typically can be perceived to have a brighter light. More specifically, the average temperature has been seen to increase by about 50° or more, which can be perceived as an increase in brightness, such as a 50% increase. Thus, for a given wattage, a bulb with a variable pitch coil will last longer and appear brighter. Although the described examples use a supply voltage of about 6 volts or less, it will be appreciated that other voltages are contemplated.

Thus, it is seen that an incandescent light bulb with a variable pitch coiled filament is provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. An incandescent flashlight bulb, comprising:

a lamp envelope;

a coiled filament; and current suppliers electrically connected to opposing ends of the coiled filament for providing a current flow through the coiled filament, wherein the pitch of said coiled filament increases with each turn gradually and between each edge and the middle of the center segment, and wherein said flashlight bulb is adapted for use with a battery power supply.

2. The flashlight bulb of claim 1, wherein the filament has a coating selected from the group consisting of ceramic and carbon.

3. The flashlight bulb of claim 1, wherein said bulb is installed in a flashlight.

4. An incandescent flashlight bulb, comprising:

a lamp envelope;

a coiled filament disposed inside the lamp envelope, the coiled filament having a pair of end segments and a central segment between the end segments, the end segments of the filament having a first coil pitch and the central segment having a second coil pitch, the first coil pitch being smaller than the second coil pitch; and current suppliers electrically connected to opposing ends of the filament for providing a current flow through the filament that is sufficient to heat the filament to a temperature at which it emits light, wherein said flashlight bulb is adapted for use with a battery power supply.

5. The flashlight bulb of claim 4 wherein the first pitch is at least five percent less than the second pitch.

6. The flashlight bulb of claim 4 wherein the first pitch is between twenty to fifty percent less than the second pitch.

7. The flashlight bulb of claim 4 wherein the first pitch is between one and ninety percent less than the second pitch.

8. The flashlight bulb of claim 4 wherein the filament is made of tungsten.

9. The flashlight bulb of claim 4 wherein the filament has a coating made of material selected from the group consisting of ceramic and carbon.

10. The flashlight bulb of claim 4 wherein a said battery power supply is electrically connected to the filament.

11. The flashlight bulb of claim 4 wherein the filament has a helical configuration.

12. The flashlight bulb of claim 4 wherein the pitch of the filament coil increases with each turn gradually and between each edge and the middle of the center segment.

13. The flashlight bulb of claim 4 wherein the pitch of the filament coil increases with each turn gradually in at least one of the end segments.

14. The flashlight bulb of claim 4 wherein the pitch of the filament increases gradually in the center segment.

15. The flashlight bulb of claim 4 wherein said current suppliers comprise a pair of current supply wires and the terminal ends of the filament are clamped in bent ends of corresponding ones of the current supply wires.

16. The flashlight bulb of claim 4 wherein the filament has a non-helical configuration.

17. The flashlight bulb of claim 4 wherein said bulb is installed in a flashlight.

* * * * *